US010775086B2

(12) United States Patent
Prins et al.

(10) Patent No.: US 10,775,086 B2
(45) Date of Patent: Sep. 15, 2020

(54) METHOD FOR CONTROLLING A VAPOUR COMPRESSION SYSTEM IN EJECTOR MODE FOR A PROLONGED TIME

(71) Applicant: Danfoss A/S, Nordborg (DK)

(72) Inventors: Jan Prins, Nordborg (DK); Frede Schmidt, Sonderborg (DK); Kenneth Bank Madsen, Ry (DK); Kristian Fredslund, Haderslev (DK)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 15/763,918

(22) PCT Filed: Oct. 14, 2016

(86) PCT No.: PCT/EP2016/074765

§ 371 (c)(1),
(2) Date: Mar. 28, 2018

(87) PCT Pub. No.: WO2017/067860

PCT Pub. Date: Apr. 27, 2017

(65) Prior Publication Data

US 2018/0283754 A1 Oct. 4, 2018

(30) Foreign Application Priority Data

Oct. 20, 2015 (DK) ..... 2015 00645

(51) Int. Cl.
*F25B 49/02* (2006.01)
*F25B 41/00* (2006.01)
(Continued)

(52) U.S. Cl.
CPC ..... *F25B 49/022* (2013.01); *F25B 1/08* (2013.01); *F25B 9/08* (2013.01); *F25B 41/00* (2013.01);
(Continued)

(58) Field of Classification Search
CPC .. F25B 49/022; F25B 1/08; F25B 9/08; F25B 2341/0012; F25B 2341/0013;
(Continued)

(56) References Cited

U.S. PATENT DOCUMENTS 1,836,318 A 12/1931 Gay
3,788,394 A 1/1974 Derragon
(Continued)

FOREIGN PATENT DOCUMENTS

CN 1309279 A 8/2001
CN 1374491 A 10/2002
(Continued)

OTHER PUBLICATIONS

US 5,385,033 A, 01/1995, Sandofsky et al. (withdrawn)
(Continued)

*Primary Examiner* — Paul Alvare
*Assistant Examiner* — Kirstin U Oswald
(74) *Attorney, Agent, or Firm* — McCormick, Paulding & Huber PLLC

(57) ABSTRACT

A method for controlling a vapour compression system having an ejector includes, in the case that a pressure difference between a pressure prevailing in the receiver and a pressure of refrigerant leaving the evaporator decreases below a first lower threshold value, the pressure of refrigerant leaving the heat rejecting heat exchanger is kept at a level which is slightly higher than the pressure level providing optimal coefficient of performance.

20 Claims, 7 Drawing Sheets

(51) Int. Cl.
*F25B 1/08* (2006.01)
*F25B 9/08* (2006.01)

(52) U.S. Cl.
CPC ..... *F25B 2341/0012* (2013.01); *F25B 2341/0661* (2013.01); *F25B 2400/075* (2013.01); *F25B 2400/13* (2013.01); *F25B 2400/16* (2013.01); *F25B 2400/23* (2013.01); *F25B 2500/29* (2013.01); *F25B 2500/31* (2013.01); *F25B 2700/19* (2013.01); *F25B 2700/197* (2013.01); *F25B 2700/21163* (2013.01)

(58) Field of Classification Search
CPC ..... F25B 2341/0014; F25B 2341/0661; F25B 2400/075; F25B 2400/13; F25B 2400/16; F25B 2700/197; F25B 41/00; F25B 2400/23; F25B 2700/19; F25B 2500/29; F25B 2500/31; F25B 2700/21163
USPC ..... 62/228.3
See application file for complete search history.

(56) References Cited

U.S. PATENT DOCUMENTS 4,067,203 A 1/1978 Behr
4,219,079 A 8/1980 Sumitomo
4,301,662 A * 11/1981 Whitnah ..... F25B 1/08 237/1 R
4,420,373 A 12/1983 Egosi
4,522,037 A * 6/1985 Ares ..... F25B 5/02 62/196.4
4,573,327 A 3/1986 Cochran
4,646,821 A 3/1987 Almqvist et al.
5,024,061 A * 6/1991 Pfeil, Jr. ..... F25B 45/00 62/292
5,226,320 A 7/1993 Dages et al.
5,553,457 A 9/1996 Reznikov
5,887,650 A 3/1999 Yang
6,305,187 B1 10/2001 Tsuboe et al.
6,698,221 B1 * 3/2004 You ..... F25B 41/00 62/196.4
6,786,056 B2 9/2004 Bash et al.
6,823,691 B2 11/2004 Ohta
7,178,359 B2 * 2/2007 Oshitani ..... F25B 41/00 62/500
7,334,427 B2 2/2008 Ozaki et al.
7,389,648 B2 * 6/2008 Concha ..... F25B 9/008 62/210
7,844,366 B2 * 11/2010 Singh ..... G06Q 50/06 700/276
8,887,524 B2 * 11/2014 Mihara ..... F25B 9/008 62/498
8,991,201 B2 3/2015 Ikegami et al.
9,217,590 B2 12/2015 Cogswell et al.
9,752,801 B2 9/2017 Verma et al.
2001/0025499 A1 * 10/2001 Takeuchi ..... F25B 41/00 62/175
2002/0124592 A1 9/2002 Takeuchi et al.
2003/0145613 A1 * 8/2003 Sakai ..... F04F 5/04 62/191
2003/0209032 A1 * 11/2003 Ohta ..... F25B 9/008 62/500
2004/0003608 A1 1/2004 Takeuchi et al.
2004/0003615 A1 * 1/2004 Yamaguchi ..... F25B 49/025 62/228.3
2004/0007014 A1 * 1/2004 Takeuchi ..... F25B 41/00 62/500
2004/0011065 A1 1/2004 Takeuchi et al.
2004/0040340 A1 * 3/2004 Takeuchi ..... B60H 1/3204 62/500
2004/0055326 A1 3/2004 Ikegami et al.
2004/0060316 A1 4/2004 Ito et al.
2004/0069011 A1 * 4/2004 Nishida ..... F25B 41/00 62/500
2004/0079102 A1 * 4/2004 Umebayashi ..... F24F 3/153 62/324.1
2004/0103685 A1 * 6/2004 Yamaguchi ..... B60H 1/00899 62/500
2004/0123624 A1 7/2004 Ohta et al.
2004/0211199 A1 * 10/2004 Ozaki ..... F25B 41/00 62/170
2004/0255602 A1 * 12/2004 Sato ..... F25B 41/04 62/159
2004/0255612 A1 * 12/2004 Nishijima ..... F25B 49/027 62/500
2004/0255613 A1 * 12/2004 Choi ..... F25B 49/027 62/500
2004/0261448 A1 * 12/2004 Nishijima ..... F25B 41/00 62/500
2006/0236708 A1 * 10/2006 Mizuno ..... F25B 49/005 62/228.3
2006/0254308 A1 * 11/2006 Yokoyama ..... F25B 39/02 62/500
2006/0277932 A1 * 12/2006 Otake ..... F25B 1/10 62/196.1
2008/0196873 A1 8/2008 Svensson
2009/0071177 A1 * 3/2009 Unezaki ..... F25B 40/00 62/196.1
2009/0241569 A1 10/2009 Okada et al.
2009/0266093 A1 * 10/2009 Aoki ..... F25B 47/025 62/155
2010/0192607 A1 * 8/2010 Unezaki ..... F25B 13/00 62/238.7
2010/0206539 A1 * 8/2010 Kim ..... F24F 11/30 165/200
2010/0319393 A1 12/2010 Ikegami et al.
2011/0005268 A1 * 1/2011 Oshitani ..... F25B 41/00 62/500
2011/0023515 A1 2/2011 Kopko et al.
2011/0041523 A1 * 2/2011 Taras ..... F25B 9/008 62/77
2011/0197606 A1 * 8/2011 Zimmermann ..... F25B 40/00 62/157
2011/0219803 A1 9/2011 Park et al.
2011/0239667 A1 10/2011 Won et al.
2011/0256005 A1 10/2011 Takeoka et al.
2011/0283723 A1 11/2011 Yakumaru
2011/0314854 A1 12/2011 Sata et al.
2012/0006041 A1 1/2012 Ikeda et al.
2012/0060523 A1 3/2012 Hung
2012/0151948 A1 * 6/2012 Ogata ..... F04C 18/3564 62/157
2012/0167601 A1 * 7/2012 Cogswell ..... F25B 41/00 62/115
2012/0180510 A1 * 7/2012 Okazaki ..... F25B 13/00 62/218
2012/0247146 A1 * 10/2012 Yamada ..... F25B 1/10 62/498
2012/0324911 A1 * 12/2012 Shedd ..... H01L 23/427 62/62
2013/0042640 A1 * 2/2013 Higashiiue ..... F25B 41/00 62/196.1
2013/0111935 A1 5/2013 Zou et al.
2013/0111944 A1 * 5/2013 Wang ..... F25B 41/00 62/500
2013/0125569 A1 5/2013 Verma et al.
2013/0174590 A1 7/2013 Sjoholm et al.
2013/0251505 A1 * 9/2013 Wang ..... F25B 41/00 415/1
2014/0208785 A1 * 7/2014 Wallace ..... F25B 9/008 62/498
2014/0326018 A1 11/2014 Ignatiev
2014/0345318 A1 11/2014 Nagano et al.
2015/0300706 A1 10/2015 Awa et al.
2015/0330691 A1 11/2015 McSweeney
2016/0109160 A1 * 4/2016 Junge ..... F25B 13/00 62/324.6
2016/0169565 A1 * 6/2016 Yokoyama ..... F04F 5/10 62/500

(56) References Cited

U.S. PATENT DOCUMENTS

| | | | | |
|---|---|---|---|---|
| 2016/0169566 | A1* | 6/2016 | Nakashima | F04F 5/04 62/500 |
| 2016/0186783 | A1 | 6/2016 | Nishijima et al. | |
| 2016/0280041 | A1 | 9/2016 | Suzuki et al. | |
| 2017/0159977 | A1 | 6/2017 | Hellmann | |
| 2017/0321941 | A1 | 11/2017 | Fredslund et al. | |
| 2017/0343245 | A1 | 11/2017 | Fredslund et al. | |
| 2018/0023850 | A1* | 1/2018 | Chaudhry | F24F 13/20 62/262 |
| 2018/0066872 | A1* | 3/2018 | Hellmann | F25B 41/00 |
| 2018/0119997 | A1* | 5/2018 | Siegert | F25B 9/006 |
| 2018/0142927 | A1* | 5/2018 | Hellmann | F25B 1/10 |
| 2018/0274821 | A1 | 9/2018 | Lee et al. | |
| 2018/0283750 | A1 | 10/2018 | Prins et al. | |
| 2018/0320944 | A1 | 11/2018 | Prins et al. | |

FOREIGN PATENT DOCUMENTS

| | | | | |
|---|---|---|---|---|
| CN | 1776324 | A | 5/2006 | |
| CN | 1892150 | A | 1/2007 | |
| CN | 101329115 | A | 12/2008 | |
| CN | 101922823 | A | 12/2010 | |
| CN | 102128508 | A | 7/2011 | |
| CN | 201992750 | U | 9/2011 | |
| CN | 202254492 | U | 5/2012 | |
| CN | 202304070 | U | 7/2012 | |
| CN | 103003641 | A | 3/2013 | |
| CN | 103282730 | A | 9/2013 | |
| CN | 104359246 | A | 2/2015 | |
| CN | 104697234 | A | 6/2015 | |
| DE | 4303669 | C1 | 1/1994 | |
| DE | 10029999 | A1 | 1/2002 | |
| DE | 10321191 | A1 | 11/2003 | |
| EP | 0005825 | A1 | 5/1979 | |
| EP | 1236959 | A2 | 9/2002 | |
| EP | 1731853 | A2 | 12/2006 | |
| EP | 2068094 | A1 | 6/2009 | |
| EP | 2077427 | A1 | 7/2009 | |
| EP | 2068094 | A1 | 10/2009 | |
| EP | 2175212 | A1 | 4/2010 | |
| EP | 2224187 | A2 | 9/2010 | |
| EP | 2504640 | A2 | 10/2012 | |
| EP | 3032208 | A1 | 6/2016 | |
| EP | 2718642 | B1 | 9/2016 | |
| EP | 3098543 | A1 * | 11/2016 | F25B 41/043 |
| FR | 2844036 | A1 | 3/2004 | |
| GB | 2164439 | A | 3/1986 | |
| JP | H04316962 | A | 11/1992 | |
| JP | H04320762 | A | 11/1992 | |
| JP | 2001221517 | A | 8/2001 | |
| JP | 2005249315 | A | 9/2005 | |
| JP | 2009097786 | A | 5/2009 | |
| JP | 2010151424 | A | 7/2010 | |
| JP | 2014077579 | A | 5/2014 | |
| KR | 100196779 | B1 | 6/1999 | |
| KR | 20080006585 | U | 12/2008 | |
| RU | 2368850 | C2 | 9/2009 | |
| RU | 2415307 | C1 | 3/2011 | |
| RU | 2555087 | C1 | 7/2015 | |
| SU | 996805 | A1 | 2/1983 | |
| WO | 2012/012488 | A1 | 1/2012 | |
| WO | 2012/012493 | A2 | 1/2012 | |
| WO | 2012012501 | A2 | 1/2012 | |
| WO | 2012/168544 | A1 | 12/2012 | |
| WO | 2014106030 | A1 | 7/2014 | |

OTHER PUBLICATIONS

International Search Report for Application No. PCT/EP2016/074765 dated Jan. 9, 2017.

Indian Office Action dated Jan. 27, 2020 for Appln. No. 201817003292.

Partial European Search Report for Serial No. 19201243.3 dated Feb. 24, 2020.

International Search Report for Application No. PCT/EP2016/074758 dated Jan. 17, 2017.

European Examination Report for Serial No. 16 781 477.1 dated Feb. 21, 2019.

Danish Search Report for Serial No. PA 2015 00644 dated May 17, 2016.

International Search Report for Application No. PCT/EP2016/074774 dated Jan. 9, 2017.

International Search Report for PCT Serial No. PCT/EP2018/057515 dated Jun. 20, 2018.

International Search Report for PCT Serial No. PCT/EP2015/064019 dated Dec. 14, 2015.

International Search Report for PCT Serial No. PCT/EP2015/073211 dated Jan. 20, 2016.

International Search Report for Application No. PCT/EP2016/065575 dated Oct. 13, 2016.

International Search Report for PCT Serial No. PCT/EP2015/073171 dated Jan. 20, 2016.

Chinese Office Action and English Translation for Serial No. 201580060854.1 dated Jan. 4, 2019.

Japanese Office Action and English Translation for Serial No. 2018-506946 dated May 12, 2020.

* cited by examiner

METHOD FOR CONTROLLING A VAPOUR COMPRESSION SYSTEM IN EJECTOR MODE FOR A PROLONGED TIME

CROSS-REFERENCE TO RELATED APPLICATIONS

This application is a National Stage application of International Patent Application No. PCT/EP2016/074765, filed on Oct. 14, 2016, which claims priority to Danish Patent Application No. PA 2015 00645, filed on Oct. 20, 2015, each of which is hereby incorporated by reference in its entirety.

FIELD OF THE INVENTION

The present invention relates to a method for controlling a vapour compression system comprising an ejector. The method of the invention allows the ejector to be operating in a wider range of operating conditions than prior art methods, thereby improving the energy efficiency of the vapour compression system.

BACKGROUND

In some vapour compression systems an ejector is arranged in a refrigerant path, at a position downstream relative to a heat rejecting heat exchanger. Thereby refrigerant leaving the heat rejecting heat exchanger is supplied to a primary inlet of the ejector. Refrigerant leaving an evaporator of the vapour compression system may be supplied to a secondary inlet of the ejector.

An ejector is a type of pump which uses the Venturi effect to increase the pressure energy of fluid at a suction inlet (or secondary inlet) of the ejector by means of a motive fluid supplied to a motive inlet (or primary inlet) of the ejector. Thereby, arranging an ejector in the refrigerant path as described above will cause the refrigerant to perform work, and thereby the power consumption of the vapour compression system is reduced as compared to the situation where no ejector is provided.

An outlet of the ejector is normally connected to a receiver, in which liquid refrigerant is separated from gaseous refrigerant. The liquid part of the refrigerant is supplied to the evaporator, via an expansion device, and the gaseous part of the refrigerant may be supplied to a compressor unit. It is desirable to operate the vapour compression system in such a manner that as large a portion as possible of the refrigerant leaving the evaporator is supplied to the secondary inlet of the ejector, and the refrigerant supply to the compressor unit is primarily provided from the gaseous outlet of the receiver, because this is the most energy efficient way of operating the vapour compression system.

At high ambient temperatures, such as during the summer period, the temperature as well as the pressure of the refrigerant leaving the heat rejecting heat exchanger is relatively high. In this case the ejector performs well, and it is advantageous to supply all of the refrigerant leaving the evaporator to the secondary inlet of the ejector, and to supply gaseous refrigerant to the compressor unit from the receiver only, as described above. When the vapour compression system is operated in this manner, it is sometimes referred to as 'summer mode'.

On the other hand, at low ambient temperatures, such as during the winter period, the temperature as well as the pressure of the refrigerant leaving the heat rejecting heat exchanger is relatively low. In this case the ejector is not performing well, and refrigerant leaving the evaporator is therefore often supplied to the compressor unit instead of to the secondary inlet of the ejector. When the vapour compression system is operated in this manner, it is sometimes referred to as 'winter mode'. As described above, this is a less energy efficient way of operating the vapour compression system, and it is therefore desirable to operate the vapour compression system in the 'summer mode', i.e. with the ejector operating, at as low ambient temperatures as possible.

US 2012/0167601 A1 discloses an ejector cycle. A heat rejecting heat exchanger is coupled to a compressor to receive compressed refrigerant. An ejector has a primary inlet coupled to the heat rejecting heat exchanger, a secondary inlet and an outlet. A separator has an inlet coupled to the outlet of the ejector, a gas outlet and a liquid outlet. The system can be switched between first and second modes. In the first mode refrigerant leaving the heat absorbing heat exchanger is supplied to the secondary inlet of the ejector. In the second mode refrigerant leaving the heat absorbing heat exchanger is supplied to the compressor.

SUMMARY

It is an object of embodiments of the invention to provide a method for controlling a vapour compression system comprising an ejector, in an energy efficient manner, even at low ambient temperatures.

It is a further object of embodiments of the invention to provide a method for controlling a vapour compression system comprising an ejector, in which the method enables the ejector to operate at lower ambient temperatures than prior art methods.

The invention provides a method for controlling a vapour compression system, the vapour compression system comprising a compressor unit, a heat rejecting heat exchanger, an ejector comprising a primary inlet, a secondary inlet and an outlet, a receiver, at least one expansion device and at least one evaporator, arranged in a refrigerant path, the method comprising the steps of:

- obtaining a temperature of refrigerant leaving the heat rejecting heat exchanger,
- deriving a reference pressure value of refrigerant leaving the heat rejecting heat exchanger, based on the obtained temperature of refrigerant leaving the heat rejecting heat exchanger,
- obtaining a pressure difference between a pressure prevailing in the receiver and a pressure of refrigerant leaving the evaporator,
- comparing the pressure difference to a predefined first lower threshold value,
- in the case that the pressure difference is higher than the first lower threshold value, controlling the vapour compression system on the basis of the derived reference pressure value, and in order to obtain a pressure of refrigerant leaving the heat rejecting heat exchanger which is equal to the derived reference pressure value, and
- in the case that the pressure difference is lower than the first lower threshold value, selecting a fixed reference pressure value corresponding to a derived reference pressure value when the pressure difference is at a predefined level which is essentially equal to the first lower threshold value, and controlling the vapour compression system on the basis of the selected fixed reference pressure value, and in order to obtain a pressure of refrigerant leaving the heat rejecting heat exchanger which is equal to the selected fixed reference pressure value.

The method according to the invention is for controlling a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor unit, comprising one or more compressors, a heat rejecting heat exchanger, an ejector, a receiver, at least one expansion device and at least one evaporator arranged in a refrigerant path. The ejector has a primary inlet connected to an outlet of the heat rejecting heat exchanger, an outlet connected to the receiver and a secondary inlet connected to outlet(s) of the evaporator(s). Each expansion device is arranged to control a supply of refrigerant to an evaporator. The heat rejecting heat exchanger could, e.g., be in the form of a condenser, in which refrigerant is at least partly condensed, or in the form of a gas cooler, in which refrigerant is cooled, but remains in a gaseous state. The expansion device(s) could, e.g., be in the form of expansion valve(s).

Thus, refrigerant flowing in the refrigerant path is compressed by the compressor(s) of the compressor unit. The compressed refrigerant is supplied to the heat rejecting heat exchanger, where heat exchange takes place with the ambient, or with a secondary fluid flow across the heat rejecting heat exchanger, in such a manner that heat is rejected from the refrigerant flowing through the heat rejecting heat exchanger. In the case that the heat rejecting heat exchanger is in the form of a condenser, the refrigerant is at least partly condensed when passing through the heat rejecting heat exchanger. In the case that the heat rejecting heat exchanger is in the form of a gas cooler, the refrigerant flowing through the heat rejecting heat exchanger is cooled, but remains in a gaseous state.

From the heat rejecting heat exchanger, the refrigerant is supplied to the primary inlet of the ejector. As the refrigerant passes through the ejector, the pressure of the refrigerant is reduced, and the refrigerant leaving the ejector will normally be in the form of a mixture of liquid and gaseous refrigerant, due to the expansion taking place in the ejector.

The refrigerant is then supplied to the receiver, where the refrigerant is separated into a liquid part and a gaseous part. The liquid part of the refrigerant is supplied to the expansion device(s), where the pressure of the refrigerant is reduced, before the refrigerant is supplied to the evaporator(s). Each expansion device supplies refrigerant to a specific evaporator, and therefore the refrigerant supply to each evaporator can be controlled individually by controlling the corresponding expansion device. The refrigerant being supplied to the evaporator(s) is thereby in a mixed gaseous and liquid state. In the evaporator(s), the liquid part of the refrigerant is at least partly evaporated, while heat exchange takes place with the ambient, or with a secondary fluid flow across the evaporator(s), in such a manner that heat is absorbed by the refrigerant flowing through the evaporator(s). Finally, the refrigerant is supplied to the compressor unit.

The gaseous part of the refrigerant in the receiver may be supplied to the compressor unit. Thereby the gaseous refrigerant is not subjected to the pressure drop introduced by the expansion device(s), and energy is conserved, as described above.

Thus, at least part of the refrigerant flowing in the refrigerant path is alternatingly compressed by the compressor(s) of the compressor unit and expanded by the expansion device(s), while heat exchange takes place at the heat rejecting heat exchanger and at the evaporator(s). Thereby cooling or heating of one or more volumes can be obtained.

According to the method of the invention, a temperature of refrigerant leaving the heat rejecting heat exchanger is initially obtained. This may include measuring the temperature of refrigerant leaving the heat rejecting heat exchanger directly by means of a temperature sensor arranged in the refrigerant path downstream relative to the heat rejecting heat exchanger. As an alternative, the temperature of refrigerant leaving the heat rejecting heat exchanger may be obtained on the basis of temperature measurements performed on an exterior part of a pipe interconnecting the heat rejecting heat exchanger and the ejector. As another alternative, the temperature of refrigerant leaving the heat rejecting heat exchanger may be derived on the basis of other suitable measured parameters, such as an ambient temperature.

Next, a reference pressure value of refrigerant leaving the heat rejecting heat exchanger is derived, based on the obtained temperature of refrigerant leaving the heat rejecting heat exchanger. For a given temperature of refrigerant leaving the heat rejecting heat exchanger there is a pressure level of refrigerant leaving the heat rejecting heat exchanger, which results in the vapour compression system operating at optimal coefficient of performance (COP). This pressure value may advantageously be selected as the reference pressure value. The higher the temperature of refrigerant leaving the heat rejecting heat exchanger, the higher the pressure level providing the optimal coefficient of performance (COP) will be.

Next, a pressure difference between a pressure prevailing in the receiver and a pressure of refrigerant leaving the evaporator is obtained, and this pressure difference is compared to a first lower threshold value.

The pressure difference between the pressure prevailing in the receiver and the pressure of refrigerant leaving the evaporator is decisive for whether or not the ejector is able to operate efficiently, i.e. whether or not the ejector is able to suck refrigerant leaving the evaporator(s) into the secondary inlet of the ejector. The first lower threshold value may advantageously be selected in such a manner that it corresponds to a pressure difference below which the ejector is expected to operate inefficiently.

In the case that the pressure difference is higher than the first lower threshold value, it can therefore be assumed that the ejector is able to operate efficiently. Therefore, in this case the vapour compression system can be operated in order to obtain optimal coefficient of performance (COP), and the ejector will still operate efficiently. Therefore, the vapour compression system is, in this case, operated in a normal manner, i.e. on the basis of the derived reference pressure value, and in order to obtain a pressure of refrigerant leaving the heat rejecting heat exchanger which is equal to the derived reference pressure value. This situation will often occur when the ambient temperature is relatively high.

On the other hand, in the case that the pressure difference is lower than the first lower threshold value, then it can be assumed that the ejector is unable to operate efficiently. Therefore, if the vapour compression system is operated in a normal manner in this case, the ejector will not be operating, and the energy efficiency of the vapour compression system is therefore decreased. This situation will often occur when the ambient temperature is relatively low.

If the vapour compression system is operated in such a manner that the pressure of refrigerant leaving the heat rejecting heat exchanger is slightly higher than the pressure level which provides optimal coefficient of performance (COP), then the coefficient of performance (COP) will only be slightly decreased. A slightly higher pressure of refrigerant leaving the heat rejecting heat exchanger results in a slightly higher pressure difference across the ejector. This increases the ability of the ejector to suck refrigerant from the outlet of the evaporator towards the secondary inlet of the ejector. Accordingly, operating the vapour compression system to obtain a slightly higher pressure of refrigerant leaving the heat rejecting heat exchanger will result in the ejector being capable of operating at lower ambient temperatures, thereby improving the energy efficiency of the vapour compression system, even though the increased pressure of refrigerant leaving the heat rejecting heat exchanger causes a slight decrease in the coefficient of performance (COP).

Therefore, in the case that the pressure difference between the pressure prevailing in the receiver and the pressure of refrigerant leaving the evaporator is lower than the first lower threshold value, a fixed reference pressure value, for the refrigerant leaving the heat rejecting heat exchanger, is selected instead of the derived reference pressure value. The fixed reference pressure value corresponds to a derived reference pressure value when the pressure difference is at a predefined level which is essentially equal to the first lower threshold value. Essentially, when the pressure difference decreases, the reference pressure value is simply maintained at the current level, when the first lower threshold value is reached. Subsequently, the vapour compression system is controlled on the basis of the fixed reference pressure value, and in order to obtain a pressure of refrigerant leaving the heat rejecting heat exchanger which is equal to the selected fixed reference pressure value. This allows the ejector of the vapour compression system to operate at lower ambient temperatures, thereby improving the energy efficiency of the vapour compression system.

The method may further comprise the steps of, in the case that the pressure difference is lower than the first lower threshold value:

- obtaining a difference between the derived reference pressure value and the selected fixed reference pressure value,
- comparing the obtained difference to a second upper threshold value, and
- in the case that the obtained difference is higher than the second upper threshold value, selecting the derived reference pressure value, and controlling the vapour compression system according to the derived reference pressure value, and in order to obtain a pressure of refrigerant leaving the heat rejecting heat exchanger which is equal to the derived reference pressure value.

According to this embodiment, if the pressure difference is lower than the first lower threshold value, and the fixed reference pressure value has therefore been selected, the temperature of refrigerant leaving the heat rejecting heat exchanger is still monitored, and the corresponding reference pressure value is derived. Thereby, the reference pressure value, which would normally be applied, is still derived, even though the fixed reference pressure value has been selected and the vapour compression system is controlled in accordance therewith.

Furthermore, a difference between the derived reference pressure value and the selected fixed reference pressure value is obtained and compared to a second upper threshold value.

In the case that the obtained difference is higher than the second upper threshold value, the derived reference pressure value is selected, and the vapour compression system is subsequently controlled on the basis thereof, as described above. Thus, if the difference between the derived reference pressure value and the fixed reference pressure value becomes too large, it is no longer considered appropriate to maintain the increased pressure of refrigerant leaving the heat rejecting heat exchanger, and therefore the 'normal' derived reference pressure value is selected instead of the increased, fixed reference pressure value, i.e. the vapour compression system is operated without the energy efficiency benefit of the ejector.

It should be noted that the second upper threshold value could be a fixed value. As an alternative, the second upper threshold value could be a variable value, such as a suitable percentage of the derived reference pressure value.

The step of obtaining a pressure difference between a pressure prevailing in the receiver and a pressure of refrigerant leaving the evaporator may comprise the step of measuring the pressure in the receiver and/or the pressure of refrigerant leaving the evaporator. As an alternative, the pressures may be obtained in other ways, e.g. by deriving the pressures from other measured parameters. As another alternative the pressure difference may be obtained without obtaining the absolute pressures of refrigerant inside the receiver and refrigerant leaving the evaporator, respectively.

The step of deriving a reference pressure may comprise using a look-up table providing corresponding values of temperature of refrigerant leaving the heat rejecting heat exchanger, pressure of refrigerant leaving the heat rejecting heat exchanger, and optimal coefficient of performance (COP) for the vapour compression system. The look-up table may, e.g., be in the form of curves representing the relationship between temperature, pressure and COP. According to this embodiment, a pressure providing optimal COP for a given temperature of refrigerant leaving the evaporator can readily be obtained.

Alternatively or additionally, the step of deriving a reference pressure value may comprise calculating the reference pressure value based on the temperature of refrigerant leaving the heat rejecting heat exchanger. This may, e.g., be done by using a predefined formula.

The steps of controlling the vapour compression system on the basis of the derived reference pressure value or on the basis of the selected fixed reference pressure value may comprise adjusting a secondary fluid flow across the heat rejecting heat exchanger. Adjusting the secondary fluid flow across the heat rejecting heat exchanger affects the heat exchange taking place in the heat rejecting heat exchanger, thereby affecting the pressure of refrigerant leaving the heat rejecting heat exchanger. In the case that the secondary fluid flow across the heat rejecting heat exchanger is an air flow, the fluid flow may be adjusted by adjusting a speed of a fan arranged to cause the air flow, or by switching one or more fans on or off. Similarly, in the case that the secondary fluid flow is a liquid flow, the fluid flow may be adjusted by adjusting a pump arranged to cause the liquid flow.

Alternatively or additionally, the steps of controlling the vapour compression system on the basis of the derived reference pressure value or on the basis of the selected fixed reference pressure value may comprise adjusting a compressor capacity of the compressor unit. This causes the pressure of refrigerant entering the heat rejecting heat exchanger to be adjusted, thereby resulting in the pressure of refrigerant leaving the heat rejecting heat exchanger being adjusted.

Alternatively or additionally, the steps of controlling the vapour compression system on the basis of the derived reference pressure value or on the basis of the selected fixed reference pressure value may comprise adjusting an opening degree of the primary inlet of the ejector. The opening degree of the primary inlet of the ejector determines a refrigerant flow from the heat rejecting heat exchanger towards the receiver. If the opening degree of the primary inlet of the ejector is increased, the flow rate of refrigerant from the heat rejecting heat exchanger is increased, thereby resulting in a decrease in the pressure of refrigerant leaving the heat rejecting heat exchanger. Similarly, a decrease in the opening degree of the primary inlet of the ejector results in an increase in the pressure of refrigerant leaving the heat rejecting heat exchanger. Furthermore, in the case that the vapour compression system comprises a high pressure valve arranged in parallel with the ejector, the pressure of refrigerant leaving the heat rejecting heat exchanger may be adjusted by opening or closing the high pressure valve, or by adjusting an opening degree of the high pressure valve.

BRIEF DESCRIPTION OF THE DRAWINGS

The invention will now be described in further detail with reference to the accompanying drawings in which.

DEATAILED DESCRIPTION

Figure 1:
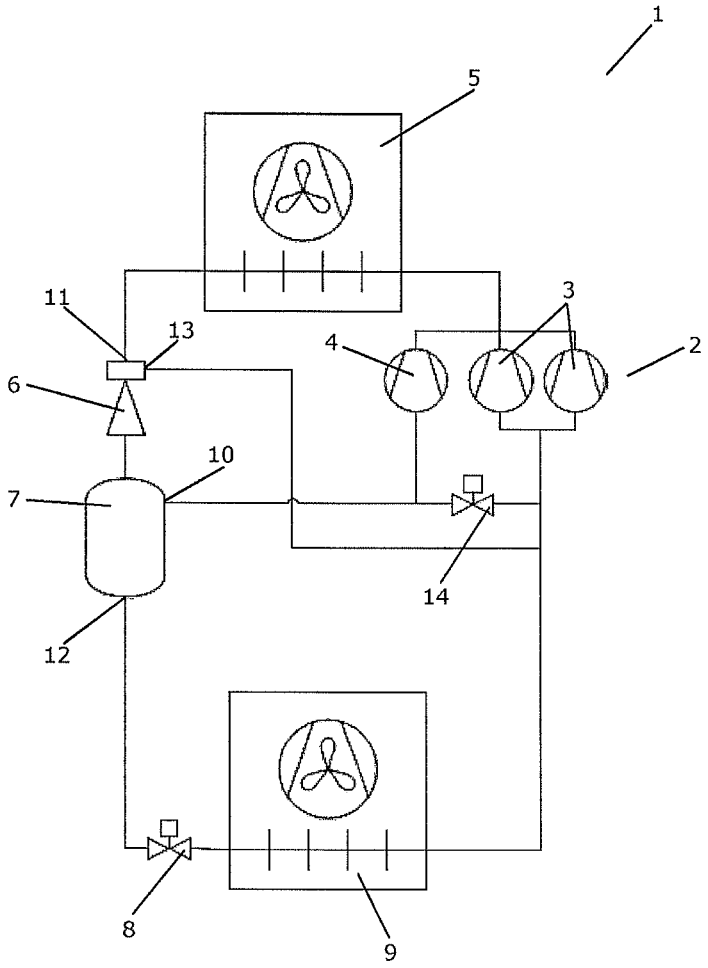
FIG. 1 is a diagrammatic view of a vapour compression system being controlled in accordance with a method according to a first embodiment of the invention.

FIG. 1 is a diagrammatic view of a vapour compression system 1 being controlled in accordance with a method according to a first embodiment of the invention. The vapour compression system 1 comprises a compressor unit 2 comprising a number of compressors 3, 4, three of which are shown, a heat rejecting heat exchanger 5, an ejector 6, a receiver 7, an expansion device 8, in the form of an expansion valve, and an evaporator 9, arranged in a refrigerant path.

Two of the shown compressors 3 are connected to an outlet of the evaporator 9. Accordingly, refrigerant leaving the evaporator 9 can be supplied to these compressors 3. The third compressor 4 is connected to a gaseous outlet 10 of the receiver 7. Accordingly, gaseous refrigerant can be supplied directly from the receiver 7 to this compressor 4.

Refrigerant flowing in the refrigerant path is compressed by the compressors 3, 4 of the compressor unit 2. The compressed refrigerant is supplied to the heat rejecting heat exchanger 5, where heat exchange takes place in such a manner that heat is rejected from the refrigerant.

The refrigerant leaving the heat rejecting heat exchanger 5 is supplied to a primary inlet 11 of the ejector 6, before being supplied to the receiver 7. When passing through the ejector 6 the refrigerant undergoes expansion. Thereby the pressure of the refrigerant is reduced, and the refrigerant being supplied to the receiver 7 is in a mixed liquid and gaseous state.

In the receiver 7 the refrigerant is separated into a liquid part and a gaseous part. The liquid part of the refrigerant is supplied to the evaporator 9, via a liquid outlet 12 of the receiver 7 and the expansion device 8. In the evaporator 9, the liquid part of the refrigerant is at least partly evaporated, while heat exchange takes place in such a manner that heat is absorbed by the refrigerant.

The refrigerant leaving the evaporator 9 is either supplied to the compressors 3 of the compressor unit 2 or to a secondary inlet 13 of the ejector 6.

The vapour compression system 1 of FIG. 1 is operated in the most energy efficient manner when all of the refrigerant leaving the evaporator 9 is supplied to the secondary inlet 13 of the ejector 6, and the compressor unit 2 only receives refrigerant from the gaseous outlet 10 of the receiver 7. In this case only compressor 4 of the compressor unit 2 is operating, while compressors 3 are switched off. It is therefore desirable to operate the vapour compression system 1 in this manner for as large a part of the total operating time as possible. However, at low ambient temperatures, where the pressure of refrigerant leaving the heat rejecting heat exchanger 5 is normally relatively low, the ejector 6 is not performing well, and therefore the refrigerant leaving the evaporator 9 will normally be supplied to the compressors 3, thereby resulting in a less energy efficient operation of the vapour compression system 1.

According to the method of the invention, the temperature of refrigerant leaving the heat rejecting heat exchanger 5 is obtained, e.g. by simply measuring the temperature of the refrigerant directly or by measuring the ambient temperature.

Based on the obtained temperature of refrigerant leaving the heat rejecting heat exchanger 5, a reference pressure value of refrigerant leaving the heat rejecting heat exchanger 5 is derived. This may, e.g., be done by consulting a look-up table or a series of curves providing corresponding values of temperature, pressure and optimal coefficient of performance. Alternatively, the reference pressure value may be derived by means of calculation. The derived reference pressure value may advantageously be the pressure of refrigerant leaving the heat rejecting heat exchanger 5, which causes the vapour compression system 1 to be operated at optimal coefficient of performance (COP), at the given temperature of refrigerant leaving the heat rejecting heat exchanger 5.

Furthermore, a pressure difference between a pressure prevailing in the receiver 7 and a pressure of refrigerant leaving the evaporator 9 is obtained and compared to a first lower threshold value. When this pressure difference becomes small, it is an indication that the operation of the vapour compression system 1 is approaching a region where the ejector 6 is not performing well. However, when the pressure difference is large, the ejector 6 can be expected to perform well.

Therefore, in the case that the pressure difference is higher than the first lower threshold value, the derived reference pressure value is selected, and the vapour compression system 1 is operated based on this reference pressure value. Accordingly, the vapour compression system 1 is simply operated as it would normally be, in order to obtain a pressure of refrigerant leaving the heat rejecting heat exchanger 5 which results in optimal coefficient of performance (COP), and the ejector 6 will automatically be operating.

On the other hand, in the case that the pressure difference is lower than the first lower threshold value, it must be expected that a region in which the ejector 6 no longer performs well is approached. Therefore, instead of the derived reference pressure value, a fixed reference pressure value is selected. The fixed reference pressure value is slightly higher than the derived reference pressure value, and it corresponds to a derived reference pressure value when the pressure difference is at a predefined level which is essentially equal to the first lower threshold value. Accordingly, in this case the vapour compression system 1 is not operated in accordance with a pressure of refrigerant leaving the heat rejecting heat exchanger 5, which provides optimal coefficient of performance (COP). Instead the ejector 6 is kept running for a prolonged time, and this provides an increase in COP which exceeds the impact of operating the vapour compression system 1 being operated at the slightly increased pressure of refrigerant leaving the heat rejecting heat exchanger 5. Thereby the overall energy efficiency of the vapour compression system 1 is improved.

The pressure of refrigerant leaving the heat rejecting heat exchanger 5 could, e.g., be adjusted by adjusting an opening degree of the primary inlet 11 of the ejector 6. Alternatively, it could be adjusted by adjusting the pressure prevailing inside the receiver 7, e.g. by adjusting the compressor capacity of the compressor 4 being connected to the gaseous outlet 10 of the receiver 7, or by adjusting a bypass valve 14 arranged in a refrigerant path interconnecting the gaseous outlet 10 of the receiver 7 and the compressors 3.

Figure 2:
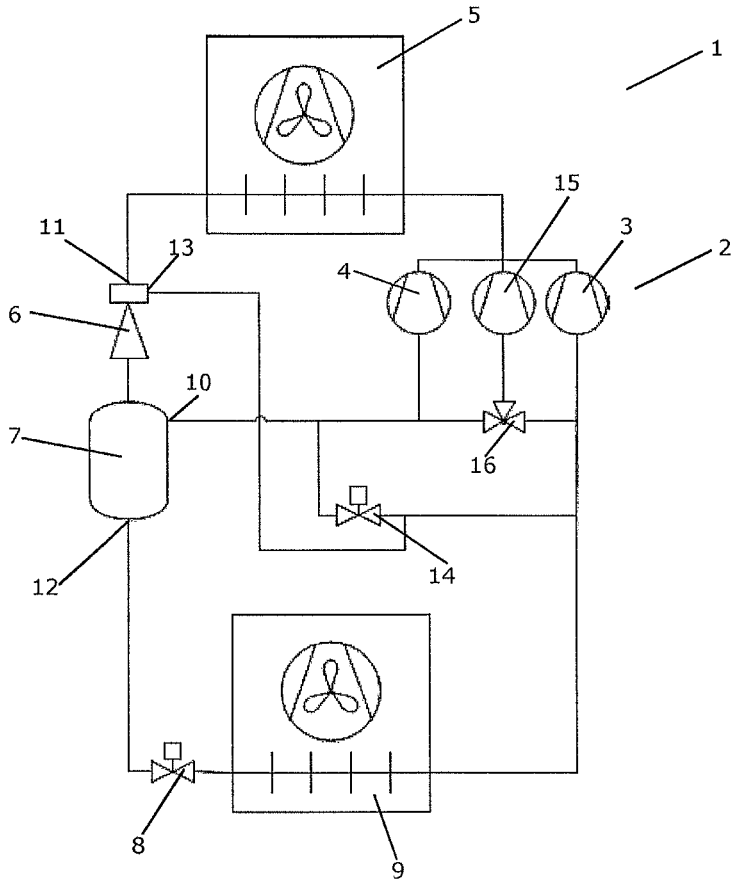
FIG. 2 is a diagrammatic view of a vapour compression system being controlled in accordance with a method according to a second embodiment of the invention.

FIG. 2 is a diagrammatic view of a vapour compression system 1 being controlled in accordance with a method according to a second embodiment of the invention. The vapour compression system 1 of FIG. 2 is very similar to the vapour compression system 1 of FIG. 1, and it will therefore not be described in detail here.

In the compressor unit 2 of the vapour compression system 1 of FIG. 2, one compressor 3 is shown as being connected to the outlet of the evaporator 9 and one compressor 4 is shown as being connected to the gaseous outlet 10 of the receiver 7. A third compressor 15 is shown as being provided with a three way valve 16 which allows the compressor 15 to be selectively connected to the outlet of the evaporator 9 or to the gaseous outlet 10 of the receiver 7. Thereby some of the compressor capacity of the compressor unit 2 can be shifted between 'main compressor capacity', i.e. when the compressor 15 is connected to the outlet of the evaporator 9, and 'receiver compressor capacity', i.e. when the compressor 15 is connected to the gaseous outlet 10 of the receiver 7. Thereby it is further possible to adjust the pressure prevailing inside the receiver 7, and thereby the pressure of refrigerant leaving the heat rejecting heat exchanger 5, by operating the three way valve 16, thereby increasing or decreasing the amount of compressor capacity being available for compressing refrigerant received from the gaseous outlet 10 of the receiver 7.

Figure 3:
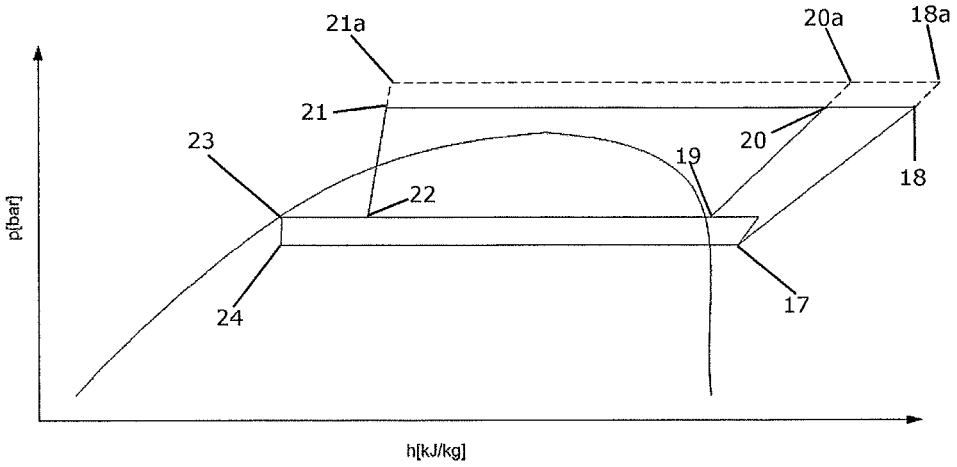
FIG. 3 is a log P-h diagram for a vapour compression system being controlled in accordance with a method according to an embodiment of the invention.

FIG. 3 is a log P-h diagram, i.e. a graph illustrating pressure as a function of enthalpy, for a vapour compression system being controlled in accordance with a method according to an embodiment of the invention. The vapour compression system could, e.g., be the vapour compression system illustrated in FIG. 1 or the vapour compression system illustrated in FIG. 2.

During normal operation of the vapour compression system, at point 17 refrigerant enters one or more compressors of the compressor unit being connected to the outlet of the evaporator. From point 17 to point 18 the refrigerant is compressed by this compressor or these compressors. Similarly, at point 19 refrigerant enters one or more compressors of the compressor unit being connected to the gaseous outlet of the receiver. From point 19 to point 20 the refrigerant is compressed by this compressor or these compressors. It can be seen that the compression results in an increase in pressure as well as in enthalpy for the refrigerant. It can further be seen, that the refrigerant received from the gaseous outlet of the receiver, at point 19, is at a higher pressure level than the refrigerant received from the outlet of the evaporator, at point 17.

From points 18 and 20, respectively, to point 21 the refrigerant passes through the heat rejecting heat exchanger, where heat exchange takes place in such a manner that heat is rejected by the refrigerant. This results in a decrease in enthalpy, while the pressure remains constant.

From point 21 to point 22 the refrigerant passes through the ejector, and is supplied to the receiver. Thereby the refrigerant undergoes expansion, resulting in a decrease in the pressure of the refrigerant and a slight decrease in enthalpy.

Point 23 represents the liquid part of the refrigerant in the receiver, and from point 23 to point 24 the refrigerant passes through the expansion device, thereby decreasing the pressure of the refrigerant. Similarly, point 19 represents the gaseous part of the refrigerant in the receiver, being supplied directly to the compressors which are connected to the gaseous outlet of the receiver.

From point 24 to point 17 the refrigerant passes through the evaporator, where heat exchanger takes place in such a manner that heat is absorbed by the refrigerant. Thereby the enthalpy of the refrigerant is increased, while the pressure remains constant.

From point 19 to point 17 the refrigerant passes from the gaseous outlet of the receiver to the suction line, i.e. the part of the refrigerant path which interconnects the outlet of the evaporator and the inlet of the compressor unit, via a bypass valve.

In the case that the control of the vapour compression system approaches a region where the ejector no longer performs well, e.g. due to low ambient temperatures, the vapour compression system is instead controlled in such a manner that the pressure of refrigerant leaving the heat rejecting heat exchanger is slightly increased, as illustrated by the dashed line of the log P-h diagram. This has the consequence that the decrease in pressure when the refrigerant passes through the ejector from point 21*a* to point 22 is larger than the decrease in pressure during normal operation, i.e. from point 21 to point 22. This improves the capability of the ejector to drive a secondary fluid flow, i.e. to suck refrigerant from the outlet of the evaporator to the secondary inlet of the ejector. Accordingly, the increased pressure of the refrigerant leaving the heat rejecting heat exchanger allows the ejector to operate at lower ambient temperatures.

Figure 4:
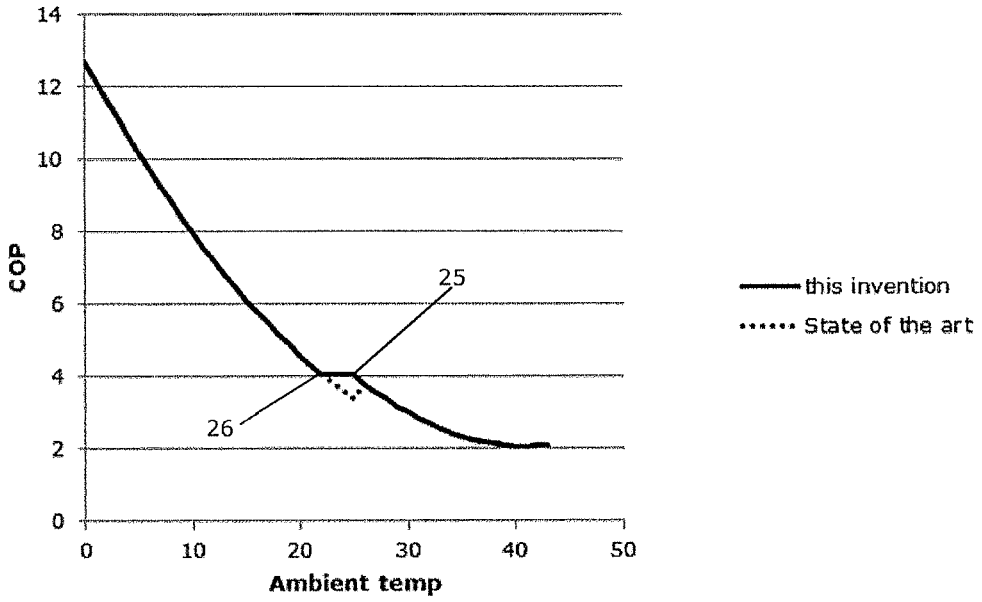
FIG. 4 is a graph illustrating coefficient of performance as a function of ambient temperature for a vapour compression system being controlled in accordance with a method according to the invention and a vapour compression system being controlled in accordance with a prior art method, respectively.

FIG. 4 is a graph illustrating coefficient of performance as a function of ambient temperature for a vapour compression system being controlled in accordance with a method according to the invention and a vapour compression system being controlled in accordance with a prior art method, respectively. The dotted line represents operation of the vapour compression system according to a prior art method, and the solid line represent operation of the vapour compression system in accordance with a method according to the invention.

At high ambient temperatures, the ejector is performing well, resulting in the vapour compression system being operated at a higher coefficient of performance (COP) than is the case when the vapour compression system is operated without the ejector.

When the ambient temperature reaches approximately 25° C., the vapour compression system approaches a region where the ejector no longer performs well. This corresponds to a pressure difference between a pressure prevailing in the receiver and a pressure of refrigerant leaving the evaporator decreasing below a first lower threshold value. Under normal circumstances, the ejector would simply stop operating at this point, resulting in the vapour compression system being operated as indicated by the dotted line. Thereby the coefficient of performance (COP) of the vapour compression system is abruptly decreased at this point.

Instead, according to the present invention, the pressure of refrigerant leaving the heat rejecting heat exchanger is maintained at a slightly increased level, resulting in the ejector being capable of operating at the lower ambient temperatures, as described above, i.e. the solid line is followed instead of the dotted line. This is illustrated by the 'kink' 25 in the graph. The increased pressure level of refrigerant leaving the heat rejecting heat exchanger is maintained until the ambient temperature reaches a level where it is no longer an advantage to keep the ejector operating, because it no longer improves the COP of the vapour compression system. This corresponds to a difference between the derived reference pressure value and the selected fixed reference pressure value increasing above a second upper threshold value. This occurs at point 26, corresponding to an ambient temperature of approximately 21° C. At lower ambient temperatures, the vapour compression system is simply operated without the ejector.

It is clear from the graph of FIG. 4 that the method according to the invention provides a transitional region between a region where the ejector performs well and a region where the ejector is not operating, thereby allowing the ejector to operate at lower ambient temperatures, i.e. approximately between 21° C. and 25° C.

Figure 5:
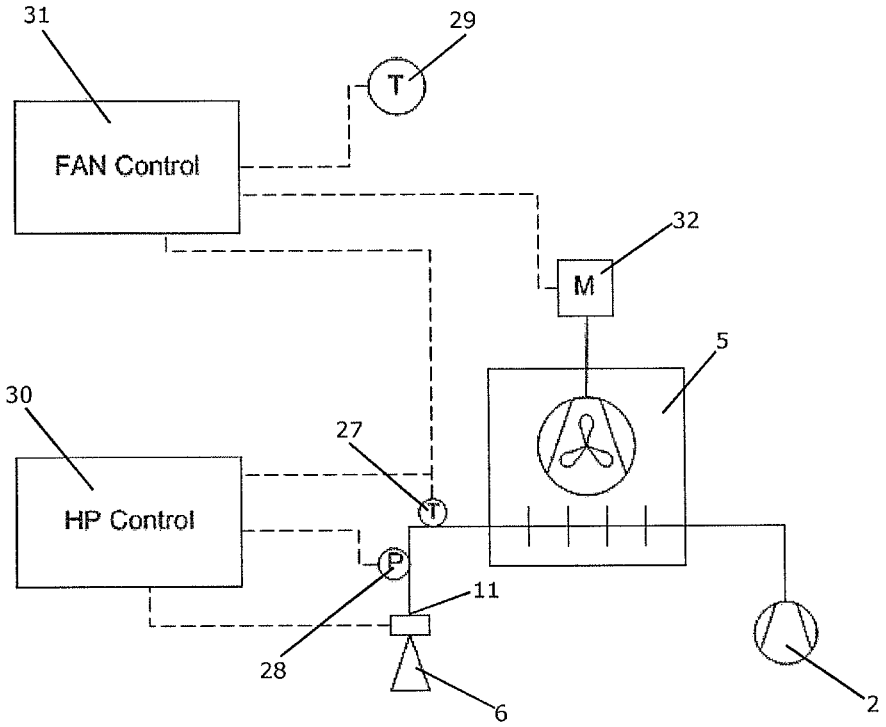
FIG. 5 illustrates control of pressure of refrigerant leaving the heat rejecting heat exchanger of a vapour compression system.

FIG. 5 illustrates control of pressure of refrigerant leaving the heat rejecting heat exchanger 5 of a vapour compression system. The vapour compression system could, e.g., be the vapour compression system of FIG. 1 or the vapour compression system of FIG. 2.

The temperature of refrigerant leaving the heat rejecting heat exchanger 5 is measured by means of temperature sensor 27, and the pressure of refrigerant leaving the heat rejecting heat exchanger 5 is measured by means of pressure sensor 28. Furthermore, the ambient temperature is measured by means of temperature sensor 29.

The measured temperature and pressure of the refrigerant leaving the heat rejecting heat exchanger 5 are supplied to a high pressure control unit 30. Based on the measured temperature of refrigerant leaving the heat rejecting heat exchanger 5, the high pressure control unit 30 selects a reference pressure value for the refrigerant leaving the heat rejecting heat exchanger, being either a derived reference pressure value or a fixed reference pressure value, as described above. The high pressure control unit 30 further ensures that the vapour compression system is controlled in order to obtain a pressure of refrigerant leaving the heat rejecting heat exchanger 5 which is equal to the selected reference pressure value. The high pressure control unit 30 does this on the basis of the measured pressure of refrigerant leaving the heat rejecting heat exchanger 5.

In order to control the pressure of refrigerant leaving the heat rejecting heat exchanger 5, the high pressure control unit 30 generates a control signal for the ejector 6. The control signal for the ejector 6 causes an opening degree of the primary inlet 11 of the ejector 6 to be adjusted. A decrease in the opening degree of the primary inlet 11 of the ejector 6 will cause the pressure of refrigerant leaving the heat rejecting heat exchanger 5 to be increased, and an increase in the opening degree of the primary inlet 11 of the ejector 6 will cause the pressure of refrigerant leaving the heat rejecting heat exchanger 5 to be decreased.

A fan control unit 31 receives the temperature of refrigerant leaving the heat rejecting heat exchanger 5, measured by the temperature sensor 27, and a temperature signal from the temperature sensor 29 measuring the ambient temperature. Based on the received signals, the fan control unit 31 generates a control signal for a motor 32 of a fan driving a secondary air flow across the heat rejecting heat exchanger 5. In response to the control signal, the motor 32 adjusts the speed of the fan, thereby adjusting the secondary air flow across the heat rejecting heat exchanger 5. A decrease in the secondary air flow across the heat rejecting heat exchanger 5 will result in an increase in the temperature of refrigerant leaving the heat rejecting heat exchanger 5. This will cause the high pressure control unit 30 to increase the pressure of refrigerant leaving the heat rejecting heat exchanger 5. Similarly, an increase in the secondary air flow across the heat rejecting heat exchanger 5 will result in a decrease in the pressure of refrigerant leaving the heat rejecting heat exchanger 5.

Alternatively, a secondary liquid flow may flow across the heat rejecting heat exchanger 5. In this case the fan control unit 31 may instead generate a control signal for a pump driving the secondary liquid flow across the heat rejecting heat exchanger 5.

Figure 6:
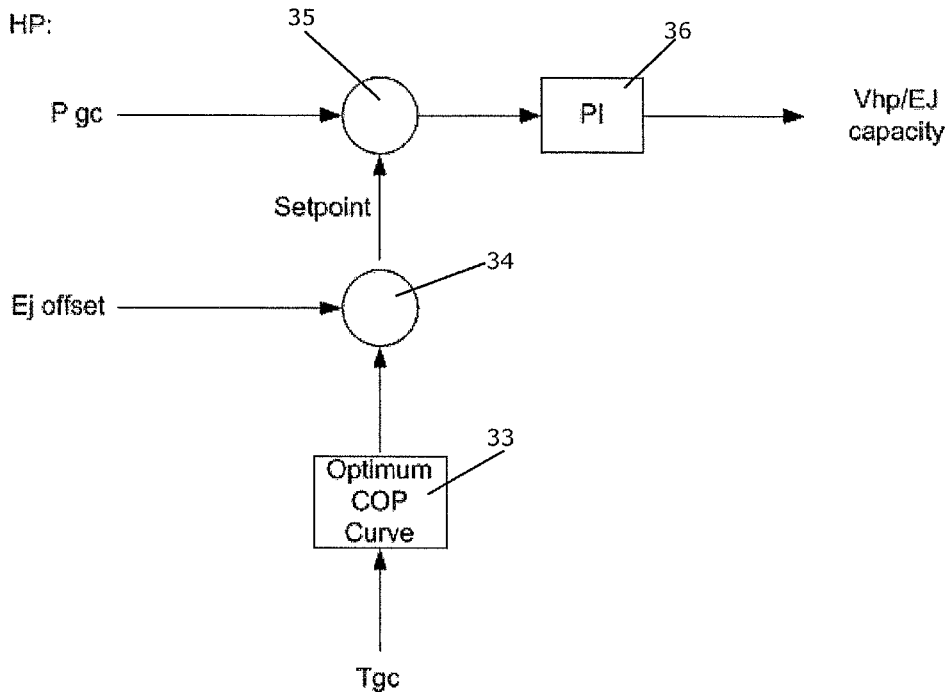
FIG. 6 is a block diagram illustrating operation of the high pressure control unit of FIG. 5.

FIG. 6 is a block diagram illustrating operation of the high pressure control unit 30 of FIG. 5. The temperature (Tgc) of refrigerant leaving the heat rejecting heat exchanger is measured and supplied to a reference pressure deriving block 33, where a reference pressure value for the pressure of refrigerant leaving the heat rejecting heat exchanger is derived, based on the measured temperature of refrigerant leaving the heat rejecting heat exchanger. The reference pressure value may be derived from a look-up table or a series of curves providing corresponding values of temperature of refrigerant leaving the heat rejecting heat exchanger, pressure of refrigerant leaving the heat rejecting heat exchanger, and coefficient of performance (COP). Thereby the derived reference pressure value is preferably the pressure value which causes the vapour compression system to be operated at optimal coefficient of performance (COP).

The derived reference pressure value is supplied to an evaluator 34, where a pressure difference between a pressure prevailing in the receiver and a pressure of refrigerant leaving the evaporator (Ej offset) is compared to a first lower threshold value. Based thereon, the evaluator 34 determines whether the derived reference pressure value or a fixed reference pressure value should be selected as a reference value for the pressure of refrigerant leaving the heat rejecting heat exchanger.

The selected reference pressure value is supplied to a comparator 35, where the reference pressure value is compared to a measured value of the pressure of refrigerant leaving the heat rejecting heat exchanger. The result of the comparison is supplied to a PI controller 36, and based thereon the PI controller 36 generates a control signal for the ejector, causing the opening degree of the primary inlet of the ejector to be adjusted in such a manner that the pressure of refrigerant leaving the heat rejecting heat exchanger reaches the reference pressure value.

Figure 7:
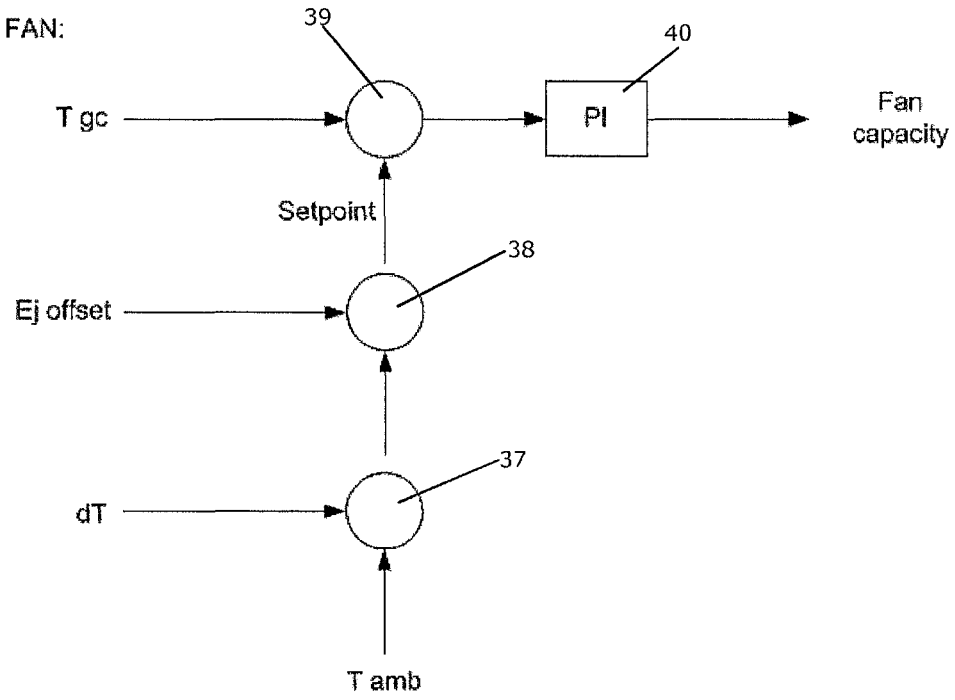
FIG. 7 is a block diagram illustrating operation of the fan control unit of FIG. 5.

FIG. 7 is a block diagram illustrating operation of the fan control unit 31 of FIG. 5. The ambient temperature (T amb) is measured and supplied to a first summation point 37, where an offset (dT) is added to the measured ambient temperature. The result of the addition is supplied to another summation point 38, where an offset (Ej offset), originating from the method according to the present invention, is added to thereto. Thereby a final temperature setpoint (Setpoint) is obtained.

The final temperature setpoint is supplied to a comparator 39, where the temperature setpoint is compared to the measured temperature of refrigerant leaving the heat rejecting heat exchanger. The result of the comparison is supplied to a PI controller 40, and based thereon the PI controller 40 generates a control signal for the motor of the fan driving the secondary air flow across the heat rejecting heat exchanger. The control signal causes the speed of the fan to be controlled in such a manner that the temperature of refrigerant leaving the heat rejecting heat exchanger reaches the reference temperature value.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a vapor compression system, the vapor compression system comprising a compressor unit, a heat rejecting heat exchanger, an ejector comprising a primary inlet, a secondary inlet and an outlet, a receiver, at least one expansion device and at least one evaporator, arranged in a refrigerant path, the method comprising the steps of:

obtaining a temperature of refrigerant leaving the heat rejecting heat exchanger, deriving a reference pressure value of refrigerant leaving the heat rejecting heat exchanger, based on the obtained temperature of refrigerant leaving the heat rejecting heat exchanger, obtaining a pressure difference between a pressure prevailing in the receiver and a pressure of refrigerant leaving the evaporator, comparing the pressure difference to a predefined first lower threshold value, in the case that the pressure difference is higher than the first lower threshold value, controlling the vapor compression system on the basis of the derived reference pressure value, and in order to obtain a pressure of refrigerant leaving the heat rejecting heat exchanger which is equal to the derived reference pressure value, and in the case that the pressure difference is lower than the first lower threshold value, selecting a fixed reference pressure value corresponding to a derived reference pressure value when the pressure difference is at a predefined level which is equal to the first lower threshold value, and controlling the vapor compression system on the basis of the selected fixed reference pressure value, and in order to obtain a pressure of refrigerant leaving the heat rejecting heat exchanger which is equal to the selected fixed reference pressure value.

2. The method according to claim 1, further comprising the steps of, in the case that the pressure difference is lower than the first lower threshold value:

obtaining a difference between the derived reference pressure value and the selected fixed reference pressure value, comparing the obtained difference to a second upper threshold value, and in the case that the obtained difference is higher than the second upper threshold value, selecting the derived reference pressure value, and controlling the vapor compression system according to the derived reference pressure value, and in order to obtain a pressure of refrigerant leaving the heat rejecting heat exchanger which is equal to the derived reference pressure value.

3. The method according to claim 2, wherein the step of obtaining a pressure difference between a pressure prevailing in the receiver and a pressure of refrigerant leaving the evaporator comprises the step of measuring the pressure in the receiver and/or the pressure of refrigerant leaving the evaporator.

4. The method according to claim 2, wherein the step of deriving a reference pressure comprises using a look-up table providing corresponding values of temperature of refrigerant leaving the heat rejecting heat exchanger, pressure of refrigerant leaving the heat rejecting heat exchanger, and optimal coefficient of performance (COP) for the vapor compression system.

5. The method according to claim 2, wherein the step of deriving a reference pressure value comprises calculating the reference pressure value based on the temperature of refrigerant leaving the heat rejecting heat exchanger.

6. The method according to claim 2, wherein the steps of controlling the vapor compression system on the basis of the derived reference pressure value or on the basis of the selected fixed reference pressure value comprises adjusting a secondary fluid flow across the heat rejecting heat exchanger.

7. The method according to claim 2, wherein the steps of controlling the vapor compression system on the basis of the derived reference pressure value or on the basis of the selected fixed reference pressure value comprises adjusting a compressor capacity of the compressor unit.

8. The method according to claim 1, wherein the step of obtaining a pressure difference between a pressure prevailing in the receiver and a pressure of refrigerant leaving the evaporator comprises the step of measuring the pressure in the receiver and/or the pressure of refrigerant leaving the evaporator.

9. The method according to claim 8, wherein the step of deriving a reference pressure comprises using a look-up table providing corresponding values of temperature of refrigerant leaving the heat rejecting heat exchanger, pressure of refrigerant leaving the heat rejecting heat exchanger, and optimal coefficient of performance (COP) for the vapor compression system.

10. The method according to claim 8, wherein the step of deriving a reference pressure value comprises calculating the reference pressure value based on the temperature of refrigerant leaving the heat rejecting heat exchanger.

11. The method according to claim 8, wherein the steps of controlling the vapor compression system on the basis of the derived reference pressure value or on the basis of the selected fixed reference pressure value comprises adjusting a secondary fluid flow across the heat rejecting heat exchanger.

12. The method according to claim 8, wherein the steps of controlling the vapor compression system on the basis of the derived reference pressure value or on the basis of the selected fixed reference pressure value comprises adjusting a compressor capacity of the compressor unit.

13. The method according to claim 1, wherein the step of deriving a reference pressure comprises using a look-up table providing corresponding values of temperature of refrigerant leaving the heat rejecting heat exchanger, pressure of refrigerant leaving the heat rejecting heat exchanger, and optimal coefficient of performance (COP) for the vapor compression system.

14. The method according to claim 13, wherein the step of deriving a reference pressure value comprises calculating the reference pressure value based on the temperature of refrigerant leaving the heat rejecting heat exchanger.

15. The method according to claim 13, wherein the steps of controlling the vapor compression system on the basis of the derived reference pressure value or on the basis of the selected fixed reference pressure value comprises adjusting a secondary fluid flow across the heat rejecting heat exchanger.

16. The method according to claim 1, wherein the step of deriving a reference pressure value comprises calculating the reference pressure value based on the temperature of refrigerant leaving the heat rejecting heat exchanger.

17. The method according to claim 16, wherein the steps of controlling the compression system on the basis of the derived reference pressure value or on the basis of the selected fixed reference pressure value comprises adjusting a secondary fluid flow across the heat rejecting heat exchanger.

18. The method according to claim 1, wherein the steps of controlling the vapor compression system on the basis of the derived reference pressure value or on the basis of the selected fixed reference pressure value comprises adjusting a secondary fluid flow across the heat rejecting heat exchanger.

19. The method according to claim 1, wherein the steps of controlling the vapor compression system on the basis of the derived reference pressure value or on the basis of the selected fixed reference pressure value comprises adjusting a compressor capacity of the compressor unit.

20. The method according to claim 1, wherein the steps of controlling the vapor compression system on the basis of the derived reference pressure value or on the basis of the selected fixed reference pressure value comprises adjusting an opening degree of the primary inlet of the ejector.

* * * * *